US007941086B2

(12) United States Patent
Kurita

(10) Patent No.: US 7,941,086 B2
(45) Date of Patent: May 10, 2011

(54) IMAGE FORMING APPARATUS AND METHOD OF COOLING RECORDING MATERIAL

(75) Inventor: Atsumi Kurita, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 576 days.

(21) Appl. No.: 12/000,871

(22) Filed: Dec. 18, 2007

(65) Prior Publication Data

US 2008/0181688 A1 Jul. 31, 2008

(30) Foreign Application Priority Data

Jan. 25, 2007 (JP) ..... P2007-015551

(51) Int. Cl.
*G03G 15/20* (2006.01)

(52) U.S. Cl. ..... 399/341

(58) Field of Classification Search ..... 399/320, 399/341, 69, 94, 406
See application file for complete search history.

(56) References Cited

U.S. PATENT DOCUMENTS

| | | | | |
|---|---|---|---|---|
| 6,741,815 | B1 * | 5/2004 | Fujita et al. | 399/45 |
| 2002/0172524 | A1 * | 11/2002 | Anderson et al. | 399/92 |
| 2004/0131406 | A1 | 7/2004 | Ohki et al. | |
| 2005/0074255 | A1 | 4/2005 | Awaya | |
| 2005/0196204 | A1 * | 9/2005 | Funato et al. | 399/341 |
| 2005/0276642 | A1 | 12/2005 | Ohki et al. | |
| 2006/0051123 | A1 | 3/2006 | Awaya | |

FOREIGN PATENT DOCUMENTS

| | | |
|---|---|---|
| CN | 1514311 | 7/2004 |
| CN | 1630836 | 6/2005 |
| JP | 3-129378 | 6/1991 |
| JP | 4-322266 | 11/1992 |
| JP | 5-150677 | 6/1993 |
| JP | 6-75490 | 3/1994 |
| JP | 7-181767 | 7/1995 |
| JP | 2003-223093 | 8/2003 |

* cited by examiner

*Primary Examiner* — David P Porta
*Assistant Examiner* — Marcus H Taningco
(74) *Attorney, Agent, or Firm* — Morgan, Lewis & Bockius LLP

(57) ABSTRACT

An image forming apparatus includes: a fixing section that heats an image formed on a recording material to fix the image to the recording material; a first cooling section that cools the recording material to which the image is fixed; and a second cooling section that cools the recording material from an opposite side of a side, to which the image is fixed, of the recording material before the first cooling section cools the recording material.

5 Claims, 5 Drawing Sheets

IMAGE FORMING APPARATUS AND METHOD OF COOLING RECORDING MATERIAL

CROSS-REFERENCE TO RELATED APPLICATION

This application is based on and claims priority under 35 USC §119 from Japanese Patent Application No. 2007-015551 filed Jan. 25, 2007.

BACKGROUND

The present invention relates to an image forming apparatus such as a copying machine and a printer, and a method of cooling a recording material in the image forming apparatus.

SUMMARY

According to an aspect of the invention, there is provided an image forming apparatus comprising:

a fixing section that heats an image formed on a recording material to fix the image to the recording material;

a first cooling section that cools the recording material to which the image is fixed; and a second cooling section that cools the recording material from an opposite side of a side, to which the image is fixed, of the recording material before the first cooling section cools the recording material.

BRIEF DESCRIPTION OF THE DRAWINGS

Embodiments of the present invention will be described in detail based on the following figures, wherein.

DETAILED DESCRIPTION

First Embodiment

Hereinafter, a first exemplary embodiment of the invention will be described with reference to the attached drawings.

Figure 1:
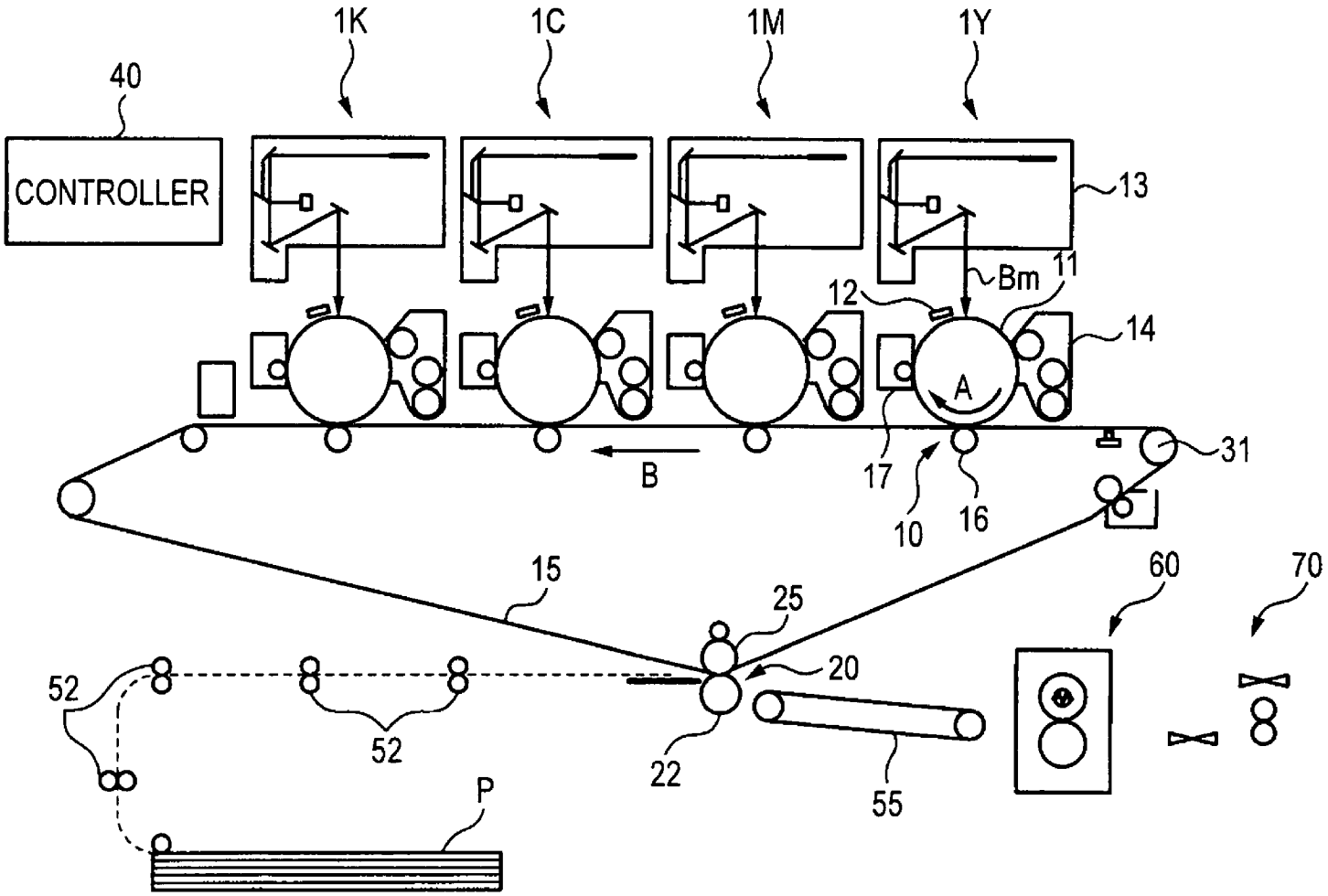
FIG. 1 is a view schematically showing a configuration of an image forming apparatus according to an exemplary embodiment of the invention.

FIG. 1 is a view schematically showing a configuration of an image forming apparatus according to an exemplary embodiment of the invention. The image forming apparatus shown in FIG. 1 is an intermediate transfer-type image forming apparatus, generally called a tandem. The image forming apparatus includes a plurality of image forming units 1Y, 1M, 1C, and 1K that form a toner image of the respective colors in an electrophotographic manner. Additionally, the image forming apparatus includes a first transfer portion 10 that sequentially transfers (first transfer) the toner image of the respective colors formed by the image forming units 1Y, 1M, 1C, and 1K to an intermediate transfer belt 15.

Further, the image forming apparatus includes a second transfer portion 20 that transfers (second transfer) overlapped toner images transferred onto the intermediate transfer belt 15 collectively to a paper P serving as a recording material (recording paper). Provided inside the intermediate transfer belt 15 are various rolls such as a driving roll 31 that hangs and supports the intermediate transfer belt 15 and rotates by the use of an excellent constant-speed motor (not shown). Furthermore, provided are a fixing device 60 as an exemplary embodiment of fixing section for fixing a second transferred image onto the paper P and a controller 40 for controlling an operation of each unit (each section). Moreover, provided are a transport roll (not shown) for ejecting a paper having an image fixed thereon to the outside of the apparatus and a transport member such as a guide member (not shown) for specifying a paper transport direction disposed on a downstream side of the paper transport direction of the fixing device 60.

Incidentally, there is a case that the toner image remains in not a completely hardened state but a still softened state on the paper even when a fixing process is performed by the fixing device 60. Then, when the toner image fixed on the paper is transported in such a state, the toner image is brought into contact with the transport member. As a result, scratches may occur on the toner image, some of the toner image may be transferred to the transport member, that is, an image offset may occur, and a gloss change may occur on the toner image.

Further, there is a case that a recent toner contains a wax made of a crystallization resin so as to easily separate a paper from a roll-shaped member (for example, a heating roll 62 described below (see FIG. 2)) provided in the fixing device. Then, in a case of containing such a wax, when the toner image fixed on the paper comes in contact with the transport member in the same way as described above, crystallization is promoted at a contact portion. As a result, a portion having a different degree of crystallization may occur on the toner image, thereby causing a linear spot on the toner image.

For this reason, in the image forming apparatus according to the first embodiment, there is provided a cooling unit 70 for cooling the paper before the paper is transported to the transport member. That is, the paper is cooled in an upstream side in the paper transport-direction from the transport member.

According to the first embodiment, following devices for electrophotographic are sequentially disposed in all image forming units 1Y, 1M, 1C, and 1K. First, charging devices 12 for charging photoconductor drums 11 rotating in the arrow A direction are disposed in the proximity of the photo conductor drums 11. Additionally, laser exposing device 13 (exposure beam is indicated by "Bm" in FIG. 1) for writing an electrostatic latent image on the photoconductor drums 11 is disposed. Further, developers 14 that hold a toner of each color and visualize, by the use of the toner, the electrostatic latent image on the photoconductor drums 11 are provided. Furthermore, first transfer rolls 16 for transferring the toner image of each color on the photo conductor drum 11 to an intermediate transfer belt 15 at a first transfer portion 10 are provided. Moreover, drum cleaners 17 for removing the toner left on the photo conductor drums 11 are provided.

The first transfer portion 10 is configured to include the first transfer roll 16 opposed to the photoconductor drum 11 with the intermediate transfer belt 15 sandwiched therebetween.

The second transfer portion 20 is configured to include a second transfer roll 22 disposed on a side of the intermediate transfer belt 15, holding the toner image, and a back-up roll 25. The second transfer roll 22 comes in press-contact with the back-up roll 25 with the intermediate transfer belt 15 sandwiched therebetween.

A controller 40 includes CPU (Central Processing Unit) for controlling an operation of each unit (each section), ROM (Read Only Memory) for recording a program, RAM (Random Access Memory) for temporarily recording various data, and the like.

Next, a basic image forming process of the image forming apparatus according to the first embodiment will be described. In the first embodiment, a personal computer (not shown), an image reading apparatus (not shown), and the like output image data. The image data undergoes an image processing operation of an image processing apparatus (not shown), whereby the image data is converted into four color-tone data of Y (yellow), M (magenta), C (cyan), and K (black), thereby outputting to the laser exposing device 13.

The laser exposing devices 13 irradiates each of the photo conductor drums 11 of the image forming units 1Y, 1M, 1C, and 1K with a laser beam Bm emitted from a semiconductor laser in the devices, on the basis of the inputted color-tone data. In each photoconductor drum 11, the charging device 12 charges the surface of the photoconductor drum 11 and then the laser exposing device 13 performs a scanning exposure operation on the surface, thereby forming the electrostatic latent image.

The formed electrostatic latent image is developed as a toner image of respective colors Y, M, C, and K by each of developers 14 of the image forming units 1Y, 1M, 1C, and 1K.

On the other hand, the intermediate transfer belt 15 is driven in a circulating manner at a speed in the arrow B direction in FIG. 1 by various rolls such as the driving roll 31. The toner images formed on the photoconductor drums 11 are electrostatically sucked onto the intermediate transfer belt 15 in a sequential order at the first transfer portion in which the photo conductor drum 11 and the intermediate transfer belt 15 come in contact with each other, whereby overlapped toner images are formed on the intermediate transfer belt 15. After the overlapped toner images are formed on the surface of the intermediate transfer belt 15, the intermediate transfer belt 15 moves so as to transport the overlapped toner images to the second transfer portion 20. At the second transfer portion 20, the second transfer roll 22 comes in contact with the back-up roll 25 with the intermediate transfer belt 15 sandwiched therebetween. At this time, the paper P transported in time by a transport roll 52 or the like is sandwiched between the intermediate transfer belt 15 and the second transfer roll 22 at the second transfer portion 20.

In the second transfer portion 20, a second transfer bias is applied between the second transfer roll 22 and the back-up roll 25, whereby a second transfer electric field is formed between both members. Then, the fixed toner images held on the intermediate transfer belt 15 is electrostatically transferred collectively onto the paper P at the second transfer portion 20. Subsequently, the paper P having the toner image transferred thereto is transported to a transport belt 55 disposed on a downstream side in the paper transport direction of the second transfer roll 22 by the second transfer roll 22. The transport belt 55 transports the paper P to the fixing device 60 at an optimal transporting speed. In the fixing device 60, a heating operation and a pressing operation are performed on the paper P having the toner image transferred thereto, and thus the toner imager is fixed on the paper P. Further, the paper P having the image fixed thereto is cooled by the cooling unit 70 and then ejected to the outside of the image forming apparatus.

Next, the fixing device 60 and the cooling unit 70 will be described.

Figure 2:
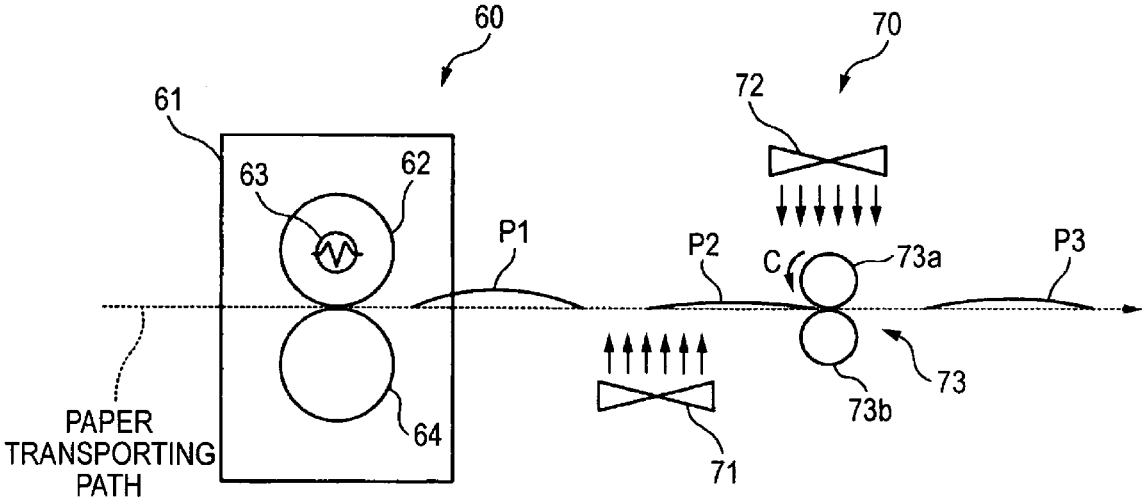
FIG. 2 is a view illustrating a fixing device and a cooling unit.

FIG. 2 is a view illustrating the fixing device 60 and the cooling unit 70.

As shown in FIG. 2, the fixing device 60 according to the first embodiment includes a supporting case 61, the heating roll 62, a heater 63, a pressing roll 64, and a driving source (not shown) for driving the heating roll 62. Additionally, the cooling unit 70 includes a first fan 71, a second fan 72, and a cooling roll 73. Further, in the first embodiment, the second fan 72 and the cooling roll 73 constitute a first cooling section, that is, a downstream cooling section.

The supporting case 61 is disposed on a position of the image forming apparatus and supports various members such as the heating roll 62 and the pressing roll 64.

The heating roll 62 as an exemplary embodiment of heating means is rotatably disposed on the supporting case 61. Additionally, the heating roll 62 has a cylindrical shape, is not covered with an elastic layer, is a hard roll in which a surface of a cored bar (core roll) such as an aluminum is covered with a heat resistant resin (fluorine contained resin). Further, an example of the heat resistant resin is tetrafluoroethylene-perfluoroalkylvinylether copolymer (PFA).

The heater 63 is disposed inside the heating roll 62 and heats the inner portion of the heating roll 62. For example, the heater 63 includes a halogen heater.

The pressing roll 64 is rotatably disposed on the supporting case 61 and disposed on the heating roll 62 in a pressed state. As a result, the pressing roll 64 is rotated, following the rotation of the heating roll 62. Additionally, the pressing roll 64 uses a cylinder-shaped roll (not shown) as a base substance. Further, a soft roll is formed by sequentially stacking the layers in order of an elastic layer (not shown) and a release layer (not shown) from the base substance side.

The first fan 71 constitutes a second cooling section, that is, an upstream cooling section, and cools the paper by blowing air onto a surface of the paper opposite to a surface heated by the heating roll 62. The first fan 71 is disposed in an upstream side in the paper transport direction from the second fan 72 and the cooling roll 73, and disposed on a downstream side in the paper transport direction from the fixing device 60. Additionally, the first fan 71 is disposed on the side of the pressing roll 64 with respect to the paper transporting path. In other words, the first fan 71 is disposed on the reverse side of the paper.

The second fan 72 cools the cooling roll 73 by blowing air onto the side of a first roll-shaped member 73*a* described later. Additionally, the second fan 72 is disposed on a downstream side in the paper transport direction from the first fan 71. Further, the second fan 72 is disposed on the side of the heating roll 62 with respect to the paper transporting path. In other words, the second fan 72 is disposed on the front side of the paper.

The cooling roll 73 includes a pair of roll-shaped members (a first roll-shaped member 73*a* and a second roll-shaped member 73*b*) and cools both surfaces, including the side on which the toner image is formed, of the paper so as to harden the toner image before the paper is transported to the transport member.

The first roll-shaped member 73*a* is rotatably disposed on the side of the heating roll 62 with respect to the paper transporting path and cools the paper from the heating roll 62. Additionally, when the paper is transported from the fixing device 60, the first roll-shaped member 73*a* is rotated in the arrow C direction shown in FIG. 2 by the driving force of the unillustrated driving source.

The second roll-shaped member 73*b* is rotatably disposed on the side of the pressing roll 64 from the paper transporting path. Additionally, when the paper is transported from the fixing device 60, the second roll-shaped member 73*b* is rotated, following the rotation of the first roll-shaped member 73*a*.

Further, in the first embodiment, the second fan 72 is disposed on the side of the first roll-shaped member 73*a*, and thus the wind blown from the second fan 72 much comes to the side of the first roll-shaped member 73*a*. For this reason, the temperature of the first roll-shaped member 73*a* is lower than that of the second roll-shaped member 73*b*.

In the configuration shown in FIG. 2, the paper transported by the transport belt 55 (see FIG. 1) undergoes a heating operation and a pressing operation at the fixing device 60. As a result, the toner image is fixed on the paper. Additionally, in the first embodiment, the toner image is formed on the side of the paper close to the heating roll 62. The paper having the image fixed thereon is cooled by the first fan 71 at first during being transported to a downstream direction. Subsequently, the image-fixed paper is cooled by the cooling roll 73. The toner image of the paper is cooled by the cooling roll 73 and thus further hardened, thereby suppressing occurrence of the scratches and the image offset on the toner image. Subsequently, the paper is transported to the downstream direction and finally ejected to the outside of the apparatus.

The inventor has knowledge that the paper is dehumidified when heated and then curled toward a surface opposite to a finally (later) dehumidified surface in a protruding manner.

As a result, when the paper having the toner image of low image density such as texts formed thereon undergoes a fixing operation in the fixing device 60, the paper is curled upward. That is, the paper is curled toward the heating roll 62 in a convex manner (see paper P1).

Specifically, when the fixing operation is performed in the fixing device 60, the paper on the side of the heating roll 62 is first dehumidified since the temperature of the heating roll 62 is higher than that of the pressing roll 64. For this reason, a moisture gradient occurs in the paper, and thus the moisture on the side of the pressing roll 64 moves to the side of the heating roll 62. As a result, the side of the pressing roll 64 is finally dehumidified. For this reason, the paper is curled in a convex manner toward the opposite side of the pressing roll 64, that is, the heating roll 62 (see paper P1).

Further, the inventor has knowledge that the cooled paper is deformed in a convex manner to the side in which a cooling degree is large.

As a result, when the paper is cooled by the first fan 71, the paper is deformed in a convex manner to the side of the first fan 71 in which the surface is much cooled, that is, the side of the pressing roll 64. Therefore, a degree of curl of the paper becomes small compared with the case where the paper is not cooled by the first fan 71 (see paper P2).

Specifically, the paper having a curl occurring in the fixing operation is transported in the paper transporting path and then cooled by the first fan 71 while being transported. As described above, the first fan 71 is disposed on the side of the pressing roll 64 with respect to the paper transporting path. For this reason, the surface of the paper close to the pressing roll 64, that is, a surface opposite to a surface heated by the heating roll 62 is more cooled than the surface heated by the heating roll 62. In other words, the opposite surface is more cooled than the surface heated by the heating roll 62. As a result, as described above, the paper is deformed to the side of the first fan 71 in which a cooling degree is large. That is, the paper is deformed in a convex manner toward the pressing roll 64 and thus a degree of curl of the paper becomes small compared with the case where the paper is not cooled by the first fan 71.

Subsequently, the paper is cooled by the cooling roll 73. In the first embodiment, as described above, the temperature of the first roll-shaped member 73*a* is lower than that of the second roll-shaped member 73*b*. For this reason, the paper is deformed in a convex manner toward the first roll-shaped member 73*a* (the side of the heating roll 62) in which a cooling degree is large after passing through the cooling roll 73. As a result, a degree of curl of the paper slightly becomes large compared with the case where the paper does not pass through the cooling roll 73 (see paper P3).

In an image forming apparatus of the background art, a member corresponding to the first fan 71 according to the first embodiment is not provided, but members corresponding to the second fan 72 and the cooling roll 73 according to the embodiment are provided to cool the paper. However, in such a configuration, a curl occurs in the fixing operation and the curl becomes very large in the cooling operation. As a result, a large curl occurs on the paper to which the cooling operation is performed. Thus, paper jam may easily occur in the course of ejecting the paper to the outside of the apparatus and recording material receiving properties of a reception unit (not shown) for receiving the ejected paper may be deteriorated.

For this reason, as described above, the first embodiment has a configuration such that the first fan 71 is disposed on a downstream side in the paper transport direction from the fixing device 60 and disposed in an upstream side in the paper transport direction from the cooling roll 73. That is, the first fan 71 for cooling the paper is configured to be disposed on the side of the pressing roll 64. In such a configuration, as described above, a degree of curl of the paper after passing through the fixing device 60 can be reduced. As a result, it is possible to reduce a degree of curl of the paper after passing through the cooling roll 73, as compared with the image forming apparatus of the background art. Further, it is possible to suppress occurrence of the paper jam and improve the recording material receiving properties of the reception unit.

Further, the first embodiment is configured such that the second fan 72 and the cooling roll 73 cool the paper after the paper is cooled by the first fan 71, but the cooling operation may be performed by the second fan 72 without the cooling roll 73.

Furthermore, the first embodiment is configured such that two fans such as the first fan 71 and the second fan 72 are provided, but the same function of the two fans may be assigned to one fan by preparing an adequate air-blow passage.

As described above, it is described about the case where a curl occurs on the paper having the toner image of low image density such as texts formed thereon. However, in the case where a curl occurs on the paper having the toner image of high image density formed thereon, a direction, an amount, and the like of the curl become different from the toner image of low image density.

Figure 3A:
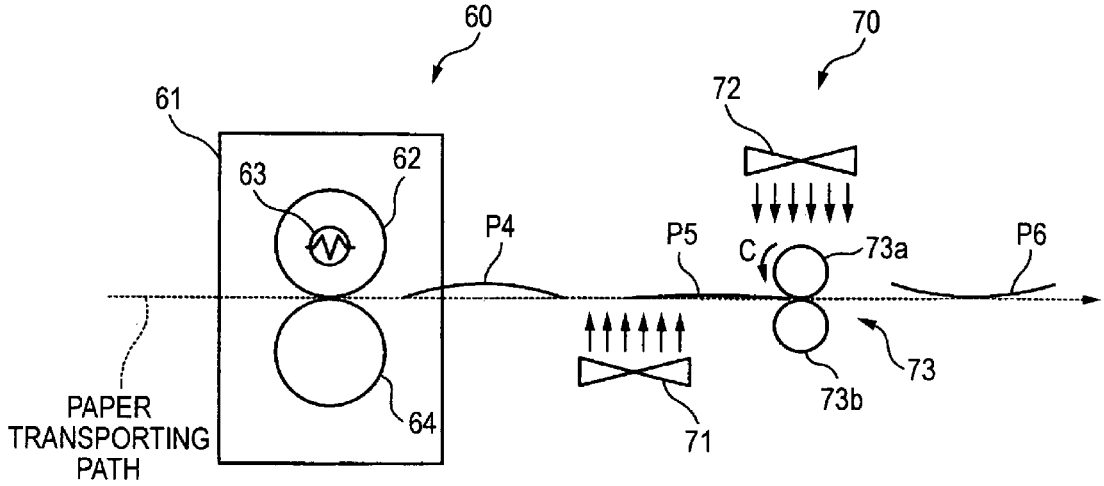
FIGS. 3A and 3B are views illustrating a case where a curl occurs when a toner image of high image density is formed.
Figure 3B:
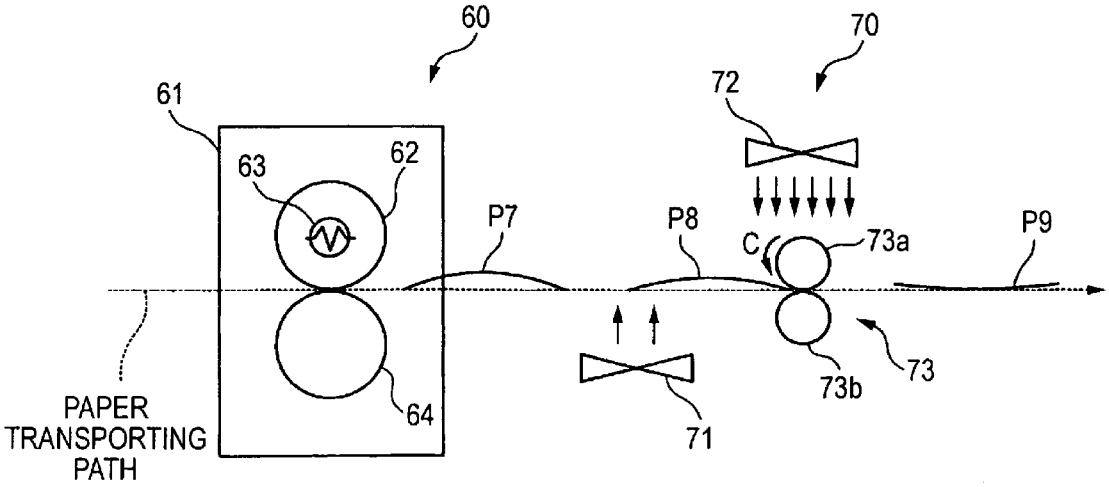

FIGS. 3A and 3B are views illustrating a case where a curl occurs when a toner image of high image density is formed.

First, FIG. 3A will be described.

When the fixing operation is performed in the fixing device 60, a curl occurs in a convex manner toward the heating roll 62 in the same manner as the paper P1 in FIG. 2 (see paper P4). Subsequently, the paper P4 is cooled by the first fan 71 and the degree of curl on the paper reduces in the same manner as the paper P2 in FIG. 2 (see paper P5).

Additionally, when the cooling operation is performed, contraction rate of the toner image normally becomes larger than that of the paper. For this reason, when the cooling operation is performed, the paper having the toner image of high density formed thereon has large contraction rate of the surface on which the toner image is formed, as compared with the paper having the toner image of low image density formed thereon. As a result, a degree of curl of the paper P5 cooled by the first fan 71 is smaller than the paper P2 in FIG. 2.

Subsequently, the paper P5 is cooled by the cooling roll 73. At this time, the paper P5 is further inclined to curl toward the heating roll 62 in the same manner as the paper P3 in FIG. 2. Incidentally, as described above, when the image density is large, the contraction rate of the toner image is larger than its opposite surface, whereby the surface on which the toner image is formed largely contracts. As a result, a curl occurs in a convex manner to the lower side, that is, to the side of the pressing roll 64 (see paper P6). As a result, in the same manner as the above description, the jam may easily occur and the reception ability of the reception unit (not shown) may be deteriorated.

Thus, in order to suppress occurrence of the issues, a detector for detecting the image density on the paper and a controller for controlling at least one of the first fan 71 and the second fan 72 or the cooling roll 73 may be provided. Specifically, it is possible to configure such that image density of the toner image formed on the paper is detected so that the first fan 71 is controlled on the basis of the detected image density. More specifically, it is possible to configure such that air volume of the first fan 71 is controlled to be large when image density of the toner image formed on the paper is small, and air volume of the first fan 71 is controlled to be small or the first fan 71 is controlled to be stopped when image density is large. Still more specifically, it is possible to configure such that image density of the toner image formed on the paper is detected so that when the detected image density is not less than a threshold value, air volume of the first fan 71 is controlled to be smaller than that in the case where the detected image density is less than a threshold value or the first fan 71 is controlled to be stopped when the detected image density is not less than a threshold value.

Additionally, the image density can be detected by the controller 40 serving as the detector. The controller 40 can detect image density of the toner image formed on the paper on the basis of image data acquired from a personal computer (not shown), an image reading apparatus (not shown), or the like. Further, the controller 40 can control the first fan 71 on the basis of the detected image density.

FIG. 3B shows a state where a curl occurs when air volume of the first fan 71 is small.

When air volume of the first fan 71 becomes small, the cooling operation of the first fan 71 becomes small, whereby a degree of curl of the paper does not reduce and a certain size of curl is maintained (see paper P8). Subsequently, when the paper P8 passes through the cooling roll 73, the surface of the toner image largely contracts. Incidentally, as described above, since a curl formed in a convex manner upwardly on the paper P8 before passing through the cooling roll 73, the curl becomes smaller than the paper P6 in FIG. 3A (see paper P9).

Additionally, the first embodiment is described about the case where air volume of the first fan 71 is controlled to be small or the first fan 71 is stopped, but may be configured such that air volume of the second fan 72 is controlled to be small so as to decrease a cooling degree (cooling effect) of the surface of the toner image. In other words, the second fan 72 may be controlled.

Next, the curl of the paper in the image forming apparatus of the background art and the curl of the paper in the image forming apparatus according to the first embodiment will be again described by referring to a specific amount of curl.

FIGS. 4A to 4D are views showing an amount of curl occurs on a paper in an image forming apparatus of the background art and an image forming apparatus according to the first embodiment. Additionally, in FIGS. 4A to 4D, the fixing device 60 is not shown. In the following description, protrusion amount of the paper is indicated by an amount of curl.

Figure 4A:
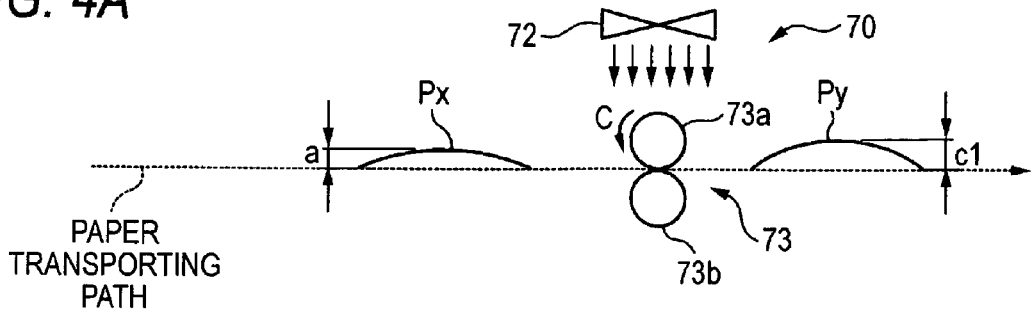
FIGS. 4A to 4D are views showing an amount of curl of a paper in an image forming apparatus of the background art and an image forming apparatus according to an exemplary embodiment of the invention.

FIG. 4A shows the degree of curl of the paper in the image forming apparatus of the background art. As shown in FIG. 4A, in the image forming apparatus of the background art, when the fixing operation is performed on the paper having the toner image of low image density, a curl having the amount "a" occurs on a paper Px on which the fixing operation is performed. Subsequently, the paper is cooled by the cooling roll 73, so that a degree of curl increases. The degree of curl of a paper Py after passing through the cooling roll 73 is "c1" that is larger than the amount "a".

Figure 4B:
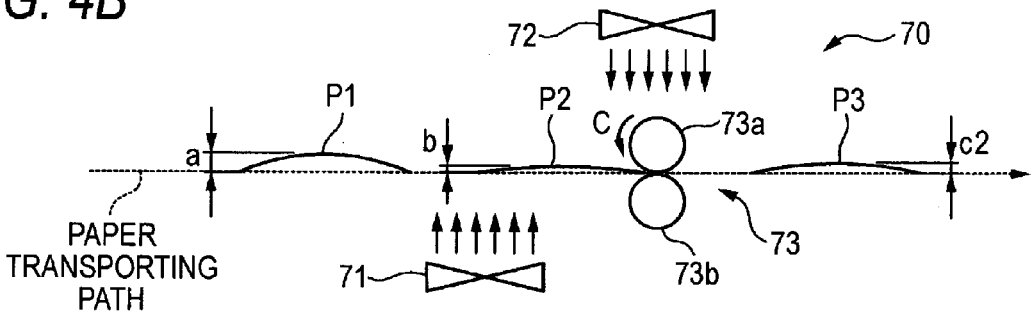

FIG. 4B shows the amount of curl of the paper in the configuration in FIG. 2. In the configuration in FIG. 2, when the fixing operation is performed on the paper having the toner image of low image density formed thereon, similarly to the known image forming apparatus, a curl of the amount "a" occurs on the paper P1 on which the fixing operation is performed. Subsequently, the paper is cooled by the first fan 71, so that a degree of curl becomes small. Specifically, a curl of amount "b" that is smaller than the amount "a" occurs on the paper cooled by the first fan 71.

Subsequently, the paper is cooled by the cooling roll 73, so that a degree of curl increases and the size of curl of the paper P3 after passing through the cooling roll 73 is "c2" that is larger than the amount "b". Incidentally, as described above, the first embodiment is configured that the first fan 71 cools the paper so as to reduce a degree of curl. For this reason, the amount "c2" of curl of the paper after passing through the cooling roll 73 is smaller than the amount "c1" of curl of the paper Py in the known image forming apparatus. As a result, it is possible to suppress occurrence of the paper jam and improve the recording material receiving properties of the reception unit.

Figure 4C:
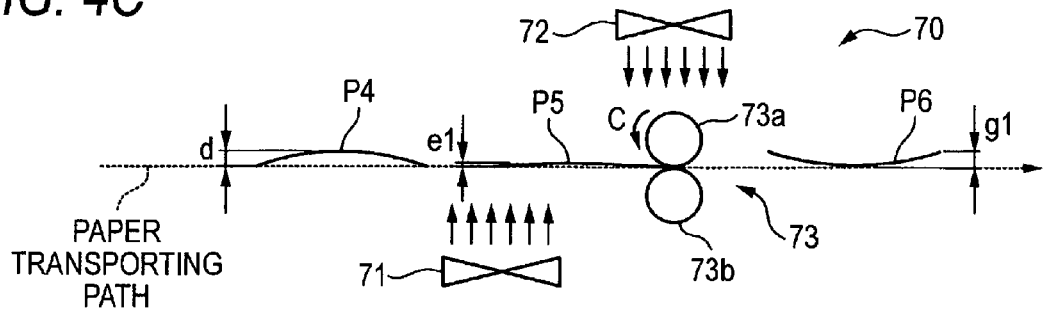

FIG. 4C shows the amount of curl of the paper in the configuration in FIG. 3A. When the fixing operation is performed to the paper having the toner image of high image density formed thereon, a curl of amount "d" occurs in a convex manner toward the heating roll 62 (see FIG. 3) (see paper P4). Subsequently, the paper is cooled by the first fan 71, so that a degree of curl is reduced and a size of curl is "e1" that is smaller than the amount "d" (see paper P5). Subsequently, the paper is cooled by the cooling roll 73, so that the forming direction of curl reverses and then a curl of amount "g1" is formed in a convex manner toward the pressing roll 64 (see FIG. 3).

Figure 4D:
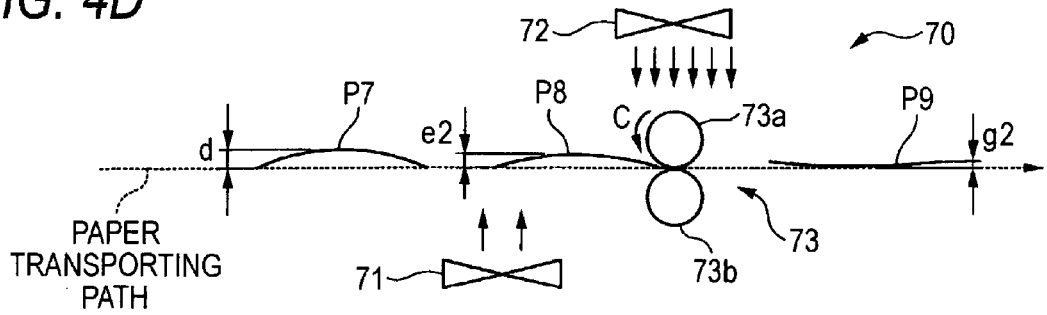

FIG. 4D shows the amount of curl of the paper in the configuration in FIG. 3B. In the configuration shown in FIG. 3B, as described above the air volume of the first fan 71 is controlled to be small. For this reason, a curl of size "e2" that is larger than the amount "e1" occurs on the paper P8 after passing through the first fan 71. Subsequently, the paper is cooled by the cooling roll 73, so that the surface of the toner image largely contracts and then a curl of amount "g2" occurs on the paper P9 after passing through the cooling roll 73. Incidentally, as described above, the first embodiment is configured such that the air volume of the first fan 71 is controlled to be small. Thus, the amount "g2" of curl finally of the paper is smaller than the amount "g1". As a result, it is possible to suppress occurrence of the paper jam and improve the recording material receiving properties of the reception unit.

Second Embodiment

Next, a second exemplary embodiment of the invention will be described.

Figure 5:
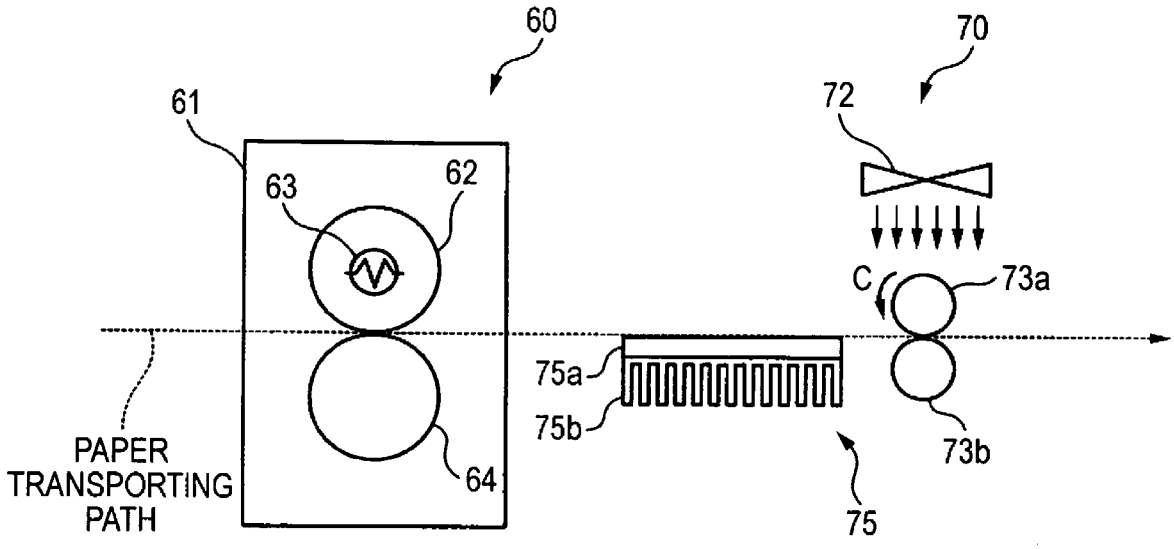
FIG. 5 is a view schematically showing a fixing device and a cooling unit according to an exemplary embodiment of the invention.

FIG. 5 is a view schematically showing the fixing device 60 and the cooling unit 70 according to a second exemplary embodiment. The first embodiment is configured such that the first fan 71 serves as a cooling section for cooling the surface of the paper on the side of the pressing roll 64, but the second embodiment is configured such that a contact member 75 disposed along the paper transporting path and brought in contact with the transported paper is provided in place of the first fan 71. Additionally, the same function as the first embodiment will be designated by the same reference numerals and the description thereof will be omitted.

In the second embodiment, the contact member 75 is configured by a metallic plate 75*a* such as aluminum disposed on the side of the pressing roll 64 with respect to the paper transporting path so as to come in contact with a transported paper and a heat sink 75*b* disposed on the opposite side with respect to the paper transporting path with the plate 75*a* interposed therebetween so as to radiate heat from the plate 75*a*. Additionally, the second embodiment is configured such that the heat sink 75*b* naturally ejects the heat, but may be configured such that a fan for cooling the heat sink 75*b* is provided. With such a configuration, it is possible to improve cooling efficiency.

The paper on which the fixing operation is performed in the fixing device 60 is cooled by the contact member 75 from the side of the pressing roll 64. For this reason, a degree of curl can be reduced in the same manner as the paper P2 (see FIG. 2) in the first embodiment. As a result, it is possible to make a degree of curl of the paper ejected from the cooling roll 73 small in the same manner as the paper P3 (see FIG. 2) in the first embodiment.

The first embodiment is configured such that the first fan 71 is disposed to be apart from the paper transporting path and the paper is cooled by using the air blown from the first fan 71. Incidentally, when cooling efficiency of the cooling roll 73 with respect to the opposite surface (a surface on the side of the pressing roll 64) of the paper is able to increase in the upstream side of the paper transport direction, a curl of the paper after passing through the cooling roll 73 can be further small.

Therefore, the second embodiment is configured such that the metallic plate 75*a* having heat transfer rate that is larger than air is provided so as to come in contact with the paper. Thus, the cooling efficiency with respect to the paper before passing through the cooling roll 73 is larger than the first embodiment.

Further, in the first embodiment, the paper may come in contact with the guide member (not shown) or the like disposed above the transporting path due to the wind from the first fan 71. When such a contact occurs, as described above, the scratches, the image offsets, and the gloss change may occur on the toner image. Therefore, the second embodiment is not configured to perform the cooling operation by using an air flow, but configured to take heat away from the paper by allowing the contact member 75 to come in contact with the paper.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a fixing section that heats an image formed on a recording material to fix the image to the recording material;

a first cooling section that cools the recording material to which the image is fixed; and a second cooling section that cools the recording material from an opposite side of a side, to which the image is fixed, of the recording material before the first cooling section cools the recording material, wherein the first cooling section includes a contact unit that contacts and cools the recording material from the side, to which the image is fixed, of the recording material, and wherein the image forming apparatus further comprising:

a detector that detects an image density of the image on the recording material; and a controller that controls at least one of the first cooling section and the second cooling section based on the image density.

2. The image forming apparatus according to claim 1, wherein when the image density is not less than a threshold value, the controller controls the second cooling section to weaken the cooling of the recording material by the second cooling section as compared with a case where the image density is less than the threshold value.

3. A method of cooling a recording material to which an image is fixed by heat, the method comprising:

cooling the recording material from an opposite side of a side, to which the image is fixed, of the recording material;

cooling the recording material from the side to which the image is fixed, and detecting an image density of the image on the recording material, wherein the method employs a contact unit that contacts and cools the recording material from the opposite side, to which the image is fixed, of the recording material, and wherein when the image density is not less than a threshold value, the cooling of the recording material from the opposite side of the recording material is weaker than the cooling of the recording material from the side to which the image is fixed.

4. An image forming apparatus comprising:

a fixing section that heats an image formed on a recording material to fix the image to the recording material;

a first cooling section that cools the recording material to which the image is fixed;

a second cooling section that cools the recording material from an opposite side of a side, to which the image is fixed, of the recording material before the first cooling section cools the recording material;

a detector that detects the image density of the image on the recording material; and a controller that controls at least one of the first cooling section and the second cooling section based on the image density.

5. The image forming apparatus according to claim 4, wherein when the image density is not less than a threshold value, the controller controls the second cooling section to weaken the cooling of the recording material by the second cooling section as compared with a case where the image density is less than the threshold value.

* * * * *